United States Patent [19]

North

[11] 4,267,017

[45] May 12, 1981

[54] DRAINAGE ROOF FOR TWIN WIRE ROLL FORMER

[75] Inventor: Merle W. North, Beloit, Wis.

[73] Assignee: Beloit Corporation, Beloit, Wis.

[21] Appl. No.: 110,597

[22] Filed: Jan. 9, 1980

[51] Int. Cl.[3] ..... D21F 1/66

[52] U.S. Cl. ..... 162/190; 162/203; 162/264; 162/275; 162/301; 162/352; 162/DIG. 7

[58] Field of Search ..... 162/203, 190, 264, 301, 162/352, DIG. 7, 275

[56] References Cited

U.S. PATENT DOCUMENTS

| | | | |
|---|---|---|---|
| 3,056,719 | 10/1962 | Webster | 162/203 |
| 3,150,037 | 9/1964 | Lee | 162/208 |
| 3,311,533 | 3/1967 | De Montigny et al. | 162/203 |
| 3,565,757 | 2/1971 | Jordansson | 162/301 |
| 3,844,881 | 10/1974 | Moody | 162/297 |
| 3,876,498 | 4/1975 | Justus | 162/203 |
| 4,028,174 | 6/1977 | Myren | 162/264 |

*Primary Examiner*—Peter Chin

*Attorney, Agent, or Firm*—Hill, Van Santen, Steadman, Chiara & Simpson

[57] ABSTRACT

A method and apparatus for forming a fibrous web between a pair of forming wires. The apparatus includes an imperforate rotatable roll and a pair of liquid permeable forming wires which meet about a portion of the surface of the rotatable roll. Means are provided for delivering a liquid suspension of fibers between the forming wires as the wires are being received about a portion of the rotatable roll. The specific improvement of the present invention is centered around an arcuate imperforate roof conforming to the periphery of the rotatable roll along a limited part of the portion in which the twin wires are forming the sheet, with injection means for injecting pressurized air along the surface of the roof to form an air film therealong. Collector means are provided at the end of the forming portion for collecting liquid expelled from the forming wires during their travel along the portion of the roll.

6 Claims, 3 Drawing Figures

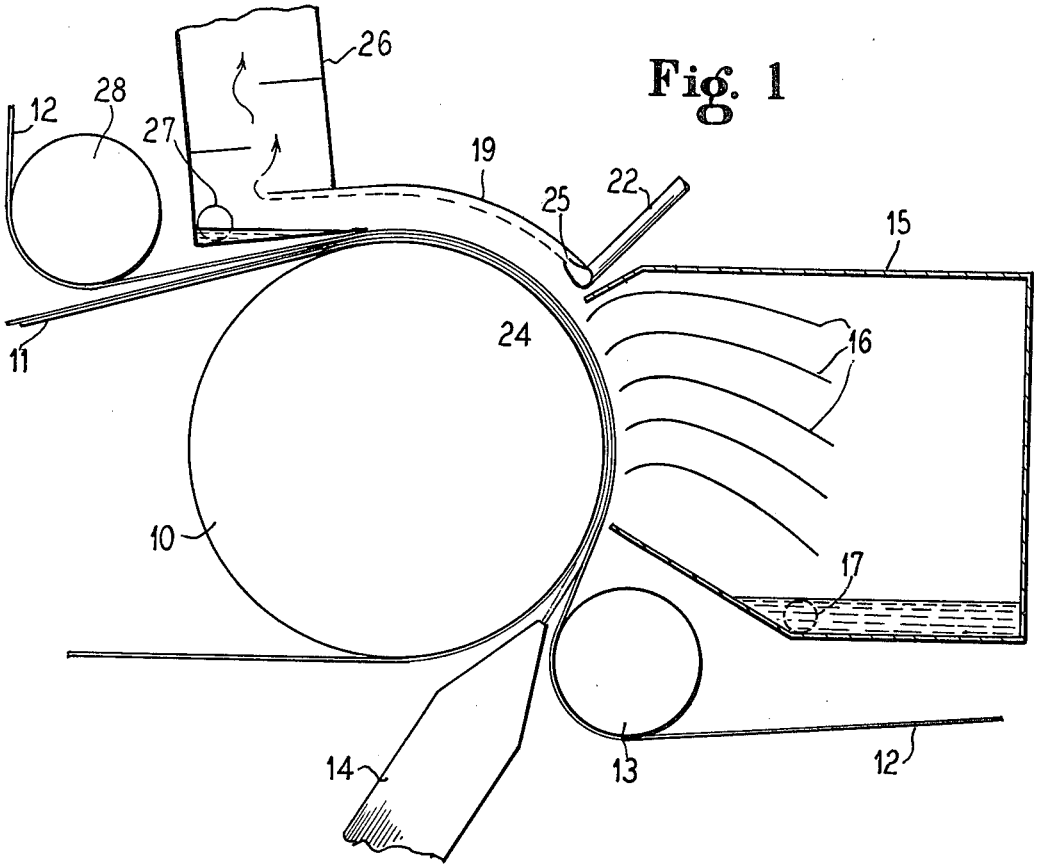
Fig. 1
Fig. 2
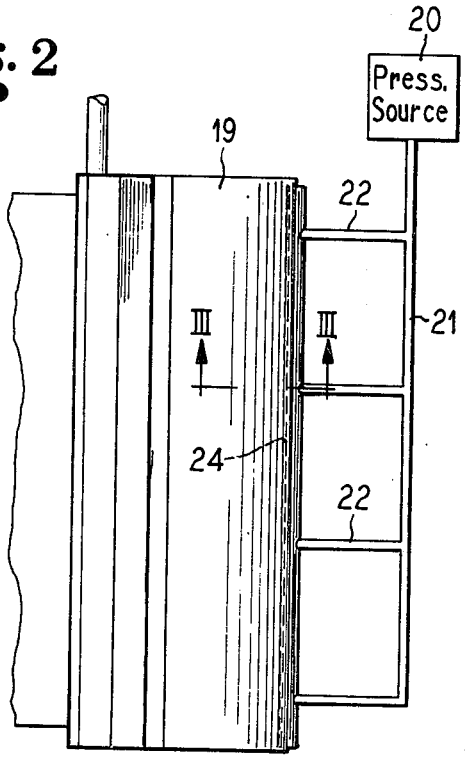
Fig. 3
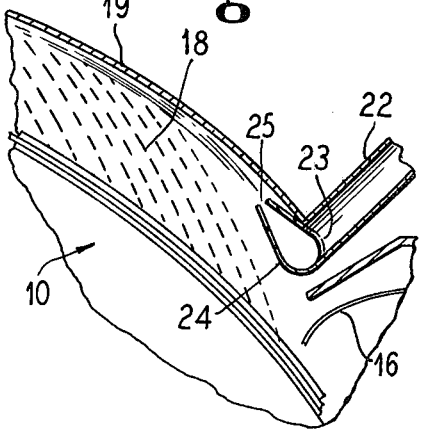

DRAINAGE ROOF FOR TWIN WIRE ROLL FORMER

BACKGROUND OF THE INVENTION

1. Field of the Invention

This invention is in the field of web forming processes and apparatus wherein a stock suspension is injected between a pair of traveling twin wires passing onto an imperforate rotatable roll. The present invention is particularly concerned with providing a pressurized air film for handling water drained from the roll former.

2. Description of the Prior Art

The following examples of prior art are submitted as representative but not as totally inclusive of the pertinent prior art in this field.

U.S. Pat. No. 3,056,719 provides a method and apparatus for producing a continuous paper sheet in which fibers in a liquid suspension are injected in the form of a jet of controlled size to the juncture between a rotating body and a yielding cooperating body, at least one of which has surfaces which are porous, thereby providing a zone extending the length of the juncture between the two. One of the bodies is rotated in the same direction as the jet, and the yielding body is tensioned to exert pressure for the other. The dynamics of the jet are such as to cause the suspension to penetrate forcibly between the two bodies thereby deflecting the yielding body. Constant tension is maintained during such deflection. Finally, the stock suspension is drained to produce a web of successively variable thickness, which web is then dried.

U.S. Pat. No. 3,150,037 describes a paper making machine using a centrifugal dewatering process. The method involves effecting rapid changes in the direction of a wet paper web while it is traveling at a relatively high speed on a foraminous carrier wire. The rapid changes in direction cause a substantial amount of the free moisture contained in the wet web to be ejected from the web by centrifugal action, while the forming wire supports the web so that it is not physically damaged due to the forces applied to the web during changes in direction. There is also a disclosure of the technique of injecting streams of air at relatively high velocity through the web to facilitate further dewatering.

U.S. Pat. No. 3,311,533 describes a dual forming wire type paper making apparatus. Two forming wires are provided which converge to provide an entrance nip for the reception of stock. In one zone, water is expressed in one direction and is collected in a suitable receptacle, and water is expressed in the other direction onto a forming wire which stores the water and transfers it to a location remote from the bands. At such location, the water is removed to a suitable receptacle, and the foraminous bands travel in contact with each other to a second zone in which the bands are in contact with the periphery of a second foraminous cylinder. An outwardly acting air flow is directed at a relatively low pressure differential at the second foraminous cylinder. In a succeeding zone, there is provided an inwardly acting air flow at a high pressure differential.

U.S. Pat. No. 3,565,757 describes an apparatus for forming and dewatering a fibrous web comprising a pair of spaced rotatable rolls, and an endless foraminous belt which is trained around portions of the two rolls and runs in a straight line between them. A second forming wire runs generally conjointly with the first forming wire around the first roll so that it defines an inlet space with the first belt in which stock in the form of a ribbon-like jet is fed. The second belt moves conjointly with the first belt along a part of the straight run from the first to the second roll and is then trained around a guide roll and separated from the first belt leaving the web on the upper surface of the first belt. The stock is dewatered in the forming zone and is formed into a web by the combination of centrifugal force and by the pressure of the outer belt against the stock resulting from the tension of the outer belt. Further dewatering is accomplished along the straight run from the forming roll to the second roll by one or more pressure or section boxes disposed along such straight run and creating a pressure differential across the web. The first and second rolls are arranged with respect to the belt such that the first belt runs to a couch roll with the web carried on its upper surface. The web is taken off the first belt somewhere along a free run after it turns around the second roll.

U.S. Pat. No. 3,844,881 describes still another multilayer paper web forming system in which a first slurry is delivered onto a moving wire opposite a section forming roll and a second slurry is deposited on the first slurry downstream of the forming roll. A second suction roll is positioned downstream of the second slurry discharge adjacent the paper web side of the screen around which the endless screen is wrapped in an arcuate path. The second suction roll may be wrapped in part by a second endless forming screen which may then travel away from the second suction roll in conjunction with the first endless forming screen.

U.S. Pat. No. 3,876,498, assigned to the same assignee as the present invention, deals with a method and apparatus for continuously forming a fibrous web from a slurry of stock. The stock is injected as a jet between two woven forming wires positioned to travel over a solid impermeable roll. A headbox is provided with trailing self-positionable elements to deliver stock to the forming throat. At the end of the forming run, the outer wire is separated from the inner wire at a separation point with a small angle between the two. The outer wire is cleaned at the separation point, and the web follows the inner wire despite the centrifugal force present on it.

Finally, U.S. Pat. No. 4,028,174 describes an apparatus for collecting liquids thrown from a moving web former. It provides a series of curved deflectors which intercept the high velocity sprays thrown from such forming member, the deflectors having holes remote from the forming member for permitting substantially all the liquid collected by the deflector to pass through the holes and in so doing to be substantially slowed in velocity. This substantially elimininates aeration from splashing and is said to considerably reduce the noise.

SUMMARY OF THE INVENTION

The present invention provides an apparatus consisting of a twin wire forming machine including an imperforate rotatable roll, a first liquid permeable forming wire which is guided about a portion of the periphery of the rotatable roll, a second liquid permeable forming wire which is likewise guided around the same portion of the periphery as the first forming wire, delivery means for delivering a liquid suspension of fibers between the forming wires as the wires are being received about that portion of the rotatable roll, and an arcuate imperforate roof conforming to the periphery of the rotatable roll along a limited part of the portion in which the wires engage the roll, together with injection means for injecting pressurized air along the surface of the roof to form an air film therealong. Collector means are also provided at the end of the portion for collecting liquid expelled from the forming wires during the travel along the aforementioned portion.

In a preferred embodiment of the present invention, the apparatus includes deflector vanes which are positioned along the rotatable roll in spaced relation between the delivery means and the injector means for removing water thrown off the wires by centrifugal force. More specifically, the roof is preferably spaced from the roll by a distance of from 1 to 3 inches (25.4 to 76.2 mm). The injection means normally includes a continuous slot which directs pressurized air at the roof, the slot measuring from 0.005 to 0.010 inch (0.127 to 0.254 mm) in width.

The method of the present invention consists in providing a rotating imperforate roll, training a pair of liquid permeable forming wires over a limited portion of the imperforate roll, depositing a fibrous stock suspension between the forming wires as they converge on the limited portion, rotating the imperforate roll at a sufficiently high velocity to cause water droplets and mist to be ejected from the stock suspension present between the forming wires, passing the forming wires and the fibrous web confined therebetween beneath a roof positioned in spaced relation to the imperforate roll, and directing a film of air between the interior of the roof and the imperforate roll to carry away water droplets and mist which could otherwise be deposited on the roof. The air film is directed at the roof at a pressure of at least 5 p.s.i. gauge.

BRIEF DESCRIPTION OF THE DRAWINGS

A further description of the present invention will be made in conjunction with the attached sheet of drawings which illustrate a preferred embodiment thereof.

FIG. 1 is a view in elevation and partly in cross section of a twin wire forming assembly which can be used in accordance with the present invention;

FIG. 2 is a plan view of the roof and air injection assembly shown in FIG. 3; and FIG. 3 is a fragmentary cross-sectional view on a somewhat enlarged scale taken substantially along the line III—III of FIG. 2.

DESCRIPTION OF THE PREFERRED EMBODIMENTS

In FIG. 1, reference numeral 10 identifies an imperforate rotating roll along which the paper web is initially formed. A first forming wire 11 engages a portion of the periphery of the roll as it rotates. A second forming wire 12 passes over guide roll 13 and then converges with the first forming wire 11 for joint passage along a limited portion of the periphery of said roll 10.

At the nip between the two forming wires 11 and 12 as they converge, there is positioned a pressurized jet 14 which delivers a suitable stock suspension between the two forming wires to initially lay down the web of fibers. The roll 10 may be rotated at a substantial velocity with the result that the centrifugal force applied to the two forming wires 11 and 12 is sufficient to expel some of the water present. Such water may be deposited in a vessel 15 which carries a plurality of arcuately shaped vanes 16 spaced from the rapidly moving wires on the roll 10. An outlet drain 17 is provided in the vessel 15 to discharge water collected therein.

As the roll continues to rotate beyond the vanes 16, additional amounts of water in the form of droplets or mist 18 (FIG. 3) are expelled from the suspension contained between the two forming wires 11 and 12. This mist 18 is directed toward a roof 19 which is of arcuate configuration and extends in substantially parallel relationship to the roll 10 over a portion of the periphery about which the forming wires 11 and 12 are traveling. The spacing of the roof 19 from the roll 10 should be fairly uniform and may extend a distance of about 1 to 3 inches (25.4 to 76.2 mm).

In order to provide an air curtain or shield against the inner surface of the roof 19 to prevent deposition of water droplets or mist thereon, I provide a pressurized air system including a pressurized source 20 which feeds a manifold 21. Air at a pressure of at least 5 p.s.i. is delivered from the manifold 21 into spaced inlet tubes 22 which, in turn, provide air under pressure to a slot 23 formed in a nozzle 24 which extends the full width of the roll 10. At its discharge end, the nozzle 24 is provided with a rectangular slot 25 having a dimension ranging from about 0.005 to 0.010 inch (0.12 to 0.254 mm). Air under pressure, as illustrated in FIG. 3, forms a film approximately tangentially to the inner surface of the roof 19. The air layer follows the curvature of the roof. Mist particles are caught up by the air stream and are then conducted into a containing vessel such as a saveall 26. Moisture vapor can exit through the saveall 26, while condensed moisture and water are withdrawn by means of an outlet tube 27.

As the forming wires 11 and 12 leave the periphery of the roll 10, the first forming wire 11 and the second forming wire 12 are separated, with the second forming wire 12 being taken around a guide roll 28, whereupon both forming wires are redirected as endless loops back into the position shown in FIG. 1.

The use of the improved drainage roof and air system of the present invention has been found to reduce friction and thereby assist the carry-over of water into the collector means instead of being deposited on the roof from where it could redeposit on the web and cause imperfections to occur.

It should be evident that various modifications can be made to the described embodiments without departing from the scope of the present invention.

I claim as my invention:

1. A twin wire forming apparatus for forming a fibrous web comprising:

an imperforate rotatable roll, a first liquid permeable forming wire, means for guiding said first forming wire about a portion of the periphery of said rotatable roll, a second liquid permeable forming wire, means for guiding said second forming wire about the same portion of said periphery as said first forming wire, delivery means for delivering a liquid suspension of fibers between said forming wires as said wires are being received about said portion of said rotatable roll, an arcuate imperforate roof conforming to the periphery of said rotatable roll along a limited part of said portion of said rotatable roll over which said two forming wires travel, injection means for injecting pressurized air along the surface of said roof to form an air film therealong, and collector means at the end of said portion for collecting liquid expelled from the forming wires during their travel along said portion.

2. An apparatus according to claim 1 which includes:

deflector vanes positioned along said rotatable roll in spaced relation between said delivery means and said injector means for removing water thrown off said wires by centrifugal force.

3. An apparatus according to claim 1 in which said roof is spaced from said roll by a distance of from 1 to 3 inches (25.4 to 76.2 mm).

4. An apparatus according to claim 1 in which:

said injection means includes a continuous slot directing pressurized air at said roof, said slot measuring from 0.005 to 0.010 inches (0.127 to 0.254 mm) in width.

5. The method of forming a fibrous web which comprises:

providing a rotating imperforate roll, training a pair of liquid permeable forming wires over a limited portion of said imperforate roll, depositing a fibrous stock suspension between said forming wires as they converge on said limited portion, rotating said imperforate roll at a sufficiently high velocity to cause water droplets and mist to be ejected from the stock suspension present between said forming wires, passing said forming wires and the fibrous web confined an imperforate roof conforming to the periphery of said imperforate roll spaced relation to said imperforate roll, injecting a film of pressurized air between the interior of said roof and said imperforate roll to carry away water droplets and mist which could otherwise be deposited on said roof and collecting the water carried away by said air film to prevent its redeposition on said forming wires.

6. A method according to claim 5 in which said air film is directed at said roof through a slot measuring from 0.005 to 0.010 inch (0.12 to 0.254 mm) at a pressure of at least 5 p.s.i. gauge.

* * * * *

UNITED STATES PATENT AND TRADEMARK OFFICE

CERTIFICATE OF CORRECTION

PATENT NO. : 4,267,017

DATED : May 12, 1981

INVENTOR(S) : Merle W. North

It is certified that error appears in the above—identified patent and that said Letters Patent is hereby corrected as shown below:

Column 6, amend lines 11 and 12 to read as follows:

--fined therebetween beneath an imperforate roof conforming to the periphery of said imperforate roll in spaced relation to--

Signed and Sealed this

*Eighteenth* Day of *August 1981*

[SEAL]

*Attest:*

GERALD J. MOSSINGHOFF

*Attesting Officer*

*Commissioner of Patents and Trademarks*